United States Patent [19]

Takata

[11] 4,152,377

[45] May 1, 1979

[54] TAMPERPROOF AUTOMATIC CHOKE

[75] Inventor: Akira Takata, Toyota, Japan

[73] Assignee: Toyota Jidosha Kogyo Kabushiki Kaisha, Japan

[21] Appl. No.: 891,142

[22] Filed: Mar. 28, 1978

[30] Foreign Application Priority Data

Dec. 22, 1977 [JP] Japan ..... 52-154871

[51] Int. Cl.[2] ..... F02M 1/10

[52] U.S. Cl. ..... 261/39 B; 123/119 F; 137/383; 137/797; 236/101 C

[58] Field of Search ..... 261/39 B; 123/119 F; 137/383, 385, 797; 236/101 C, 101 D

[56] References Cited

U.S. PATENT DOCUMENTS

| | | | |
|---|---|---|---|
| 1,936,301 | 11/1933 | Hansen et al. | 137/797 |
| 3,279,771 | 10/1966 | Herman et al. | 261/39 B |
| 3,593,549 | 7/1971 | Lakins | 137/383 |
| 3,907,943 | 9/1975 | Tateno et al. | 261/39 B |
| 4,054,620 | 10/1977 | Daigler | 261/39 B |

*Primary Examiner*—Tim R. Miles

*Attorney, Agent, or Firm*—Stevens, Davis, Miller & Mosher

[57] ABSTRACT

An automatic choke having a casing, a cover, and a spiral bimetal element disposed in a chamber defined by the casing and the cover and connected at its one end with the cover and at the other end with a choke valve shaft rotatably supported by the casing, wherein the cover is mounted to the casing by a mounting means which permits rotational adjustment of the cover relative to the casing, while a positioning means such as a pin and a socket is provided between the casing and the cover in its initial assembly, the positioning means permitting normal mounting of the cover to the casing only when the cover is in a predetermined rotational position relative to the casing.

3 Claims, 4 Drawing Figures

FIG. 4
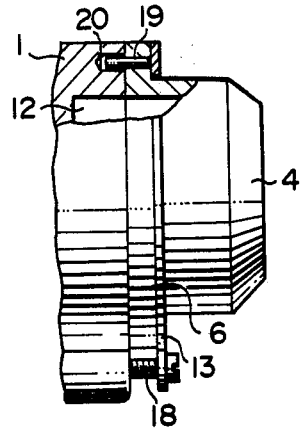
FIG. 1
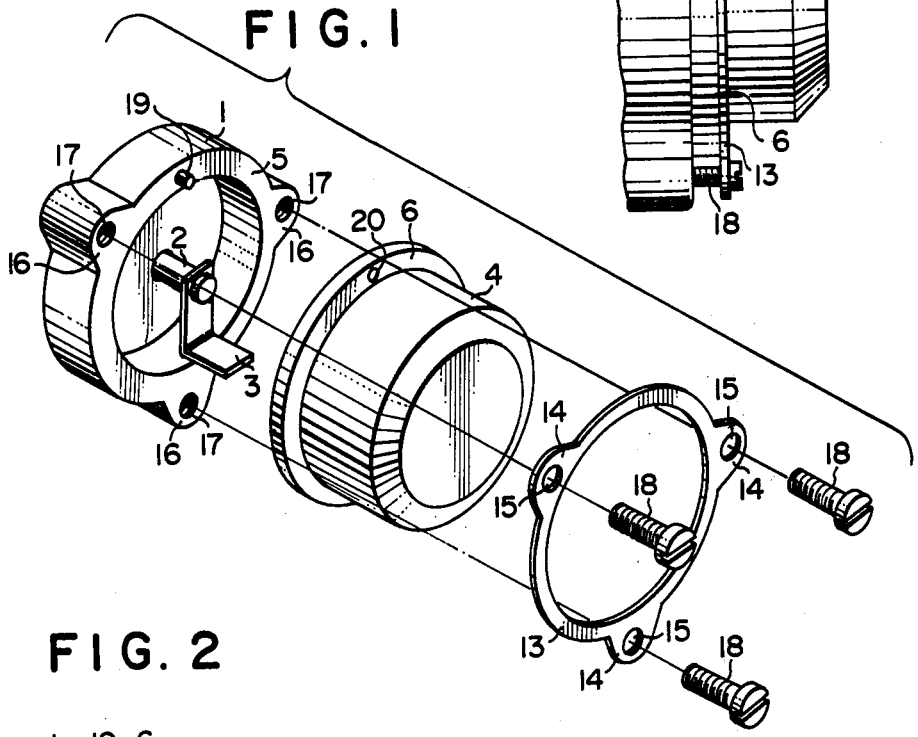
FIG. 2
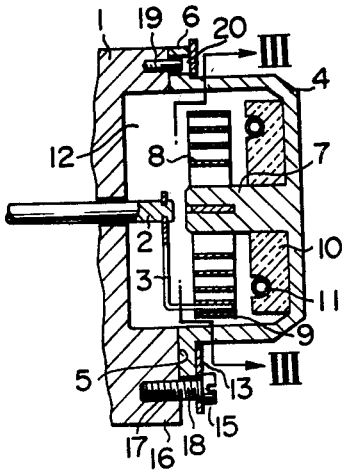
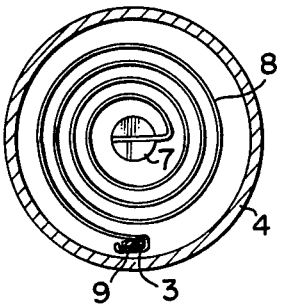
FIG. 3

TAMPERPROOF AUTOMATIC CHOKE

BACKGROUND OF THE INVENTION

The present invention relates to an automatic choke to be incorporated in a carburetor for use with internal combustion engines, and, more particularly, to an improvement of an automatic choke having a tamperproof structure.

An automatic choke incorporated in a carburetor of an internal combustion engine generally comprises a choke valve shaft, a casing which is mounted to the body of the carburetor and rotatably supports said choke valve shaft, a cover mounted to said casing so as to define a chamber in co-operation with said casing, a cover mounting means such as a set of mounting ring and screws which mounts said cover to said casing in a manner such that said cover is adjustable relative to said casing with respect to its rotational position around the axis of said choke valve shaft, and a spiral bimetal element disposed in said chamber and having one end connected with said cover and the other end connected with said choke valve shaft. The spiral bimetal element contracts or expands corresponding to the warming-up condition of the engine and operates to drive the choke valve shaft so as to close the intake bore of the carburetor by a choke valve supported by the choke valve shaft when the engine is in the cold state and gradually to open the intake bore by turning the choke valve as the engine is warmed up. Since the performance of such a choking action performed by the automatic choke has a great influence on the startability,, drivability, fuel consumption and exhaust gas emission of the engine, the initial mounting of the spiral bimetal element must be strictly controlled to satisfy the required mounting condition, and it is also important that the initial adjustment in the mounting of the spiral bimetal element should be incapable of being disturbed during vehicle maintenance. On the other hand, it is practically impossible to manufacture every spiral bimetal element strictly to the same dimensions. Therefore, conventionally, the deviations of individual spiral bimetal elements from the standard dimensional condition are compensated for by rotational adjustment of the cover relative to the casing in the process of mounting the cover to the casing by employing a cover mounting means such as mentioned above which permits such rotational adjustment. In this case, the adjustment is generally performed in a manner such that a particular spiral bimetal element is first mounted at one end thereof to a particular cover which is still in free condition and in this condition the position of the other end of the spiral bimetal element relative to the cover is marked on a proper peripheral portion of the cover by paint or the like. In the subsequent assembling process the cover is mounted to the casing while its rotational position relative to the casing is adjusted depending upon the aforementioned guidemark by employing a cover mounting means as mentioned above which mounts the cover to the casing while permitting the cover to be adjusted relative to the casing with respect to its rotational position around the axis of the choke valve shaft. However, this conventional method is liable to cause incorrect mounting of the cover to the casing due to misreading of the indication mark. Furthermore, this conventional method of adjustment does not guarantee that the initial adjustment of the spiral bimetal element is maintained without being changed by the user of the automobile or by an inexperienced engineer during maintenance.

SUMMARY OF THE INVENTION

It is therefore the object of the present invention to provide an automatic choke in which the correct adjustment of the spiral bimetal element is definitely ensured at the time of initial assembly and the initial adjustment of the spiral bimetal element is immune to tampering readjustment in further operation.

In accordance with the present invention, the above-mentioned object is accomplished by providing an automatic choke comprising a choke valve shaft, a casing which rotatably supports said choke valve shaft, a cover mounted to said casing so as to define a chamber in co-operation with said casing, a cover mounting means which mounts said cover to said casing in a manner such that said cover is adjustable relative to said casing with respect to its rotational position substantially around the axis of said choke valve shaft, a spiral bimetal element disposed in said chamber and having one end connected with said cover and the other end connected with said choke valve shaft, and a positioning means provided between said casing and said cover and adapted to permit normal mounting of said cover to said casing only when said cover is in a predetermined rotational position relative to said casing.

BRIEF DESCRIPTION OF THE DRAWING

The present invention will become more fully understood from the detailed description given hereinbelow and the accompanying drawings which are given by way of illustration only, and thus are not limitative of the present invention and wherein:

FIG. 1 is an exploded perspective view of an embodiment of the automatic choke of the present invention;

FIG. 2 is a longitudinal sectional view of the automatic choke shown in FIG. 1, the choke being shown in its assembled condition;

FIG. 3 is a sectional view along line III—III; and

FIG. 4 is a side view partly in longitudinal section of another automatic choke incorporating another embodiment of the present invention.

DESCRIPTION OF THE PREFERRED EMBODIMENT

Referring to FIGS. 1-3, an automatic choke herein shown comprises a cup-shaped casing 1 adapted to be mounted to a corresponding seat portion of a carburetor not shown in the figure. The casing 1 rotatably supports one end portion of a choke valve shaft 2 which further extends to the left in FIG. 2 where it suppors a choke valve not shown in the figure which is disposed in the intake bore of the carburetor, also not shown in the figure. A choke lever 3 is fixedly mounted to the shown end portion of the choke valve shaft 2. A cover 4, which is also a cup-shaped member, is mounted to the casing 1 in such a manner that a circular flange portion 6 of the cover engages a circular mounting surface 5 of the casing and a chamber 12 is defined by the co-operation of these two members. The cover 4 has a shaft portion 7 at its inside central portion, and a spiral bimetal element 8 is mounted by one end, i.e. at its inner end, to the central shaft portion. From this inner end the spiral bimetal element extends spirally outwardly towards its outer end where it is formed into a hook 9 which engages with an angularly bent end of the choke lever 3. The spiral bimetal element 8 is so made that when it is cold, it loosens so as to drive the choke lever 3 clockwise as seen in FIG. 3, thereby closing the choke valve, and, when it is heated up, the spiral tightens up so as to drive the choke lever 3 anticlockwise as seen in FIG. 3 thereby opening the choke valve. In a bottom portion of the cover 4 is mounted an annular insulator element 10 which supports an electric heating element 11. This electric heating element is supplied with a controlled electric current which varies in accordance with the engine temperature.

13 designates a mounting ring having three tab portions 14 each having an opening 15. The mounting ring is so made to engage over the flange portion 6 of the cover 4. Corresponding to the spacing between the three tab portions 14 and the openings 15 of the mounting ring 13, the casing 1 has three tab portions 16 and three threaded bores 17. By engaging the mounting ring 13 over the flange portion 6 of the cover 4 and driving three screws 18 through the openings 15 of the mounting flange into the three threaded bores 17, the cover 4 is mounted to the casing 1 with its flange portion 6 contacting the mounting face portion 5 of the casing.

Without a positioning means such as a pin 19 and an opening 20 provided between the casing 1 and the cover 4 and explained hereinunder, the cover 4 is mounted to the casing 1 by the aforementioned mounting means such as the mounting ring 13 and the screws 18 in a manner such that the rotational position of the cover relative to the casing may be optionally adjusted. In this case, if the central axis of the choke valve shaft 2 is substantially aligned with the center of the circular mounting face portion 5 of the casing 1 and that of the circular flange portion 6 of the cover 4, the rotational position of the cover relative to the casing is adjustable substantially around the axis of the choke valve shaft. However, in accordance with the present invention, the relative rotational position between the casing 1 and the cover 4 is definitely determined by the engagement of the pin 19 mounted to the mounting surface portion 5 of the casing and the opening 20 formed in the flange portion 6 of the cover. By the provision of the pin 19 projecting from the flat mounting surface portion 5 of the casing, if the predetermined relative rotational position between the casing and the cover is not exactly satisfied, the pin 19 interferes with the flange portion 6 and does not permit normal mounting of the cover to the casing.

In assembling, the spiral bimetal element 8 is first mounted at its inner end to the central shaft portion 7 of the cover 4 which is still in free condition. Then the other end of the spiral bimetal element will radially oppose to a particular peripheral portion of the cover 4. This position will slightly change in accordance with individual spiral bimetal elements due to their manufacturing errors. In accordance with the position of the individual particular peripheral portion indicated by the free end of each individual spiral bimetal element, each individual cover 4 is pierced during assembly of the automatic choke with an opening 20 at a position which changes in accordance with the manufacturing error of the individual spiral bimetal element. On the other hand, the pin 19 is mounted at a predetermined standard position in all casings. By this arrangement, the deviations of individual spiral bimetal elements from the standard dimensional condition are individually compensated for by the corresponding rotational adjustment of the cover, i.e. the inner end of the spiral bimetal element mounted to the cover, relative to the casing. Deviations of the dimensional conditions between the casing 1 and the choke valve shaft 2 or the choke lever 3 firmly mounted to the shaft from the standard design conditions due to manufacturing errors are very small when compared with those of the spiral bimetal element and are substantially negligible. Therefore no individual adjustment with regard to this point is required.

FIG. 4 shows a modification of the positioning means provided between the casing and the cover. In this modification, the pin 19 is mounted to the flange portion 6 of the cover 4, while the opening 20 is formed in the casing 1. It will be apparent that this modification operates substantially in the same manner as the embodiment shown in FIGS. 1–3.

Although the invention has been shown and described with respect to some preferred embodiments thereof, it should be understood by those skilled in the art that various changes and omissions of the form and the detail thereof may be made therein without departing from the scope of the invention.

I claims

1. An automatic choke comprising a choke valve shaft, a casing which rotatably supports said choke valve shaft, a cover mounted to said casing so as to define a chamber in co-operation with said casing, a cover mounting means which mounts said cover to said casing in a manner such that said cover is adjustable relative to said casing with respect to its rotational position substantially around the axis of said choke valve shaft, a spiral bimetal element disposed in said chamber and having one end connected with said cover and the other end connected with said choke valve shaft, and a positioning means provided between said casing and said cover and adapted to permit normal mounting of said cover to said casing only when said cover is in a predetermined rotational position with respect to said casing.

2. The automatic choke of claim 1, wherein said positioning means includes a pin mounted to said casing at its mounting surface portion which engages said cover, and an opening formed in said cover at its mounting surface portion which engages said casing.

3. The automatic choke of claim 1, wherein said positioning means includes a pin mounted to said cover at its mounting surface portion which engages said casing, and an opening formed in said casing at its mounting surface portion which engages said cover.

* * * * *